United States Patent [19]

Oudman

[11] Patent Number: 4,616,887

[45] Date of Patent: Oct. 14, 1986

[54] ADJUSTABLE WORK TOP

[75] Inventor: Dirk J. Oudman, Assen, Netherlands

[73] Assignee: Wigboma B.V., Netherlands

[21] Appl. No.: 603,112

[22] Filed: Apr. 23, 1984

[51] Int. Cl.[4] ..... A47B 57/06

[52] U.S. Cl. ..... 312/140.1; 312/312

[58] Field of Search ..... 312/140.1, 306, 312, 312/228, 245

[56] References Cited

U.S. PATENT DOCUMENTS 3,443,850 5/1969 Scime et al. ..... 312/312

4,151,804 5/1979 Wache et al. ..... 312/312

FOREIGN PATENT DOCUMENTS 2061700 5/1981 United Kingdom ..... 312/228

*Primary Examiner*—William E. Lyddane

*Assistant Examiner*—Joseph Falk

*Attorney, Agent, or Firm*—Silverman, Cass, Singer & Winburn, Ltd.

[57] ABSTRACT

An adjustable work top, in particular suitable for a kitchen, comprising means for vertically adjusting the work top. Said means for vertically adjusting the work top comprise at least one electric motor-driven lifting device attachable vertically to a wall. Said lifting device is provided with attachment members for a horizontally extending carrier arm for the work top mountable in cantilever fashion, and an electric control device is provided for controlling the electric motor.

15 Claims, 4 Drawing Figures

ADJUSTABLE WORK TOP

The invention relates to an adjustable work top, in particular suitable for a kitchen, comprising means for vertically adjusting the work top.

A kitchen having an adjustable work top is known from the published Dutch patent application 81,03998. The kitchen known from Dutch application No. 81,03998 comprises a work top mounted in cantilever fashion, which is vertically adjustable by means of a lifting device and under which a wheel chair can be driven. As a result, the prior art kitchen is highly suitable for wheel chair users, but also for aged or handicapped persons not needing to use a wheel chair.

Such kitchens can be installed advantageously e.g. in hospitals, rehabilitation centres, houses for aged persons and the like.

An adjustable work top of the type employed in the prior art kitchen, however, can also be used in laboratories, so that it is possible to work on the work top both in sitting and in standing position. Also other applications are conceivable; the adjustable work top may e.g. be designed as a writing table or form part of a wall unit.

Although the prior art adjustable work top is satisfactory in practice, it can be improved in a number of points. For instance, there is a need for an adjustable work top that is designed in such a manner that when the work top is adjusted, also wall cupboards possibly mounted above the work top move together with the top, so that also the height of the wall cupboards is fitted to the wishes of the user.

Furthermore, there is a need for a good and safe control device for adjusting the desired height of the work top.

It is an object of the invention to meet these needs and more in general to provide a universally applicable and reliable, vertically adjustable work top.

To this end according to the invention, an adjustable work top of the above described type is characterized in that the means for vertically adjusting the work top comprise at least one lifting device vertically attachable to a wall and driven by an electric motor, said device being provided with attachment members for a horizontally extending carrier arm for the work top mountable in cantilever fashion; and that there is provided an electric control device for controlling the electric motor.

One embodiment of the invention will now be described, by way of example, with reference to the accompanying drawings, in which:

FIG. 1 diagrammatically shows an embodiment of a vertically adjustable work top according the invention, used in a kitchen;

Figure 1:
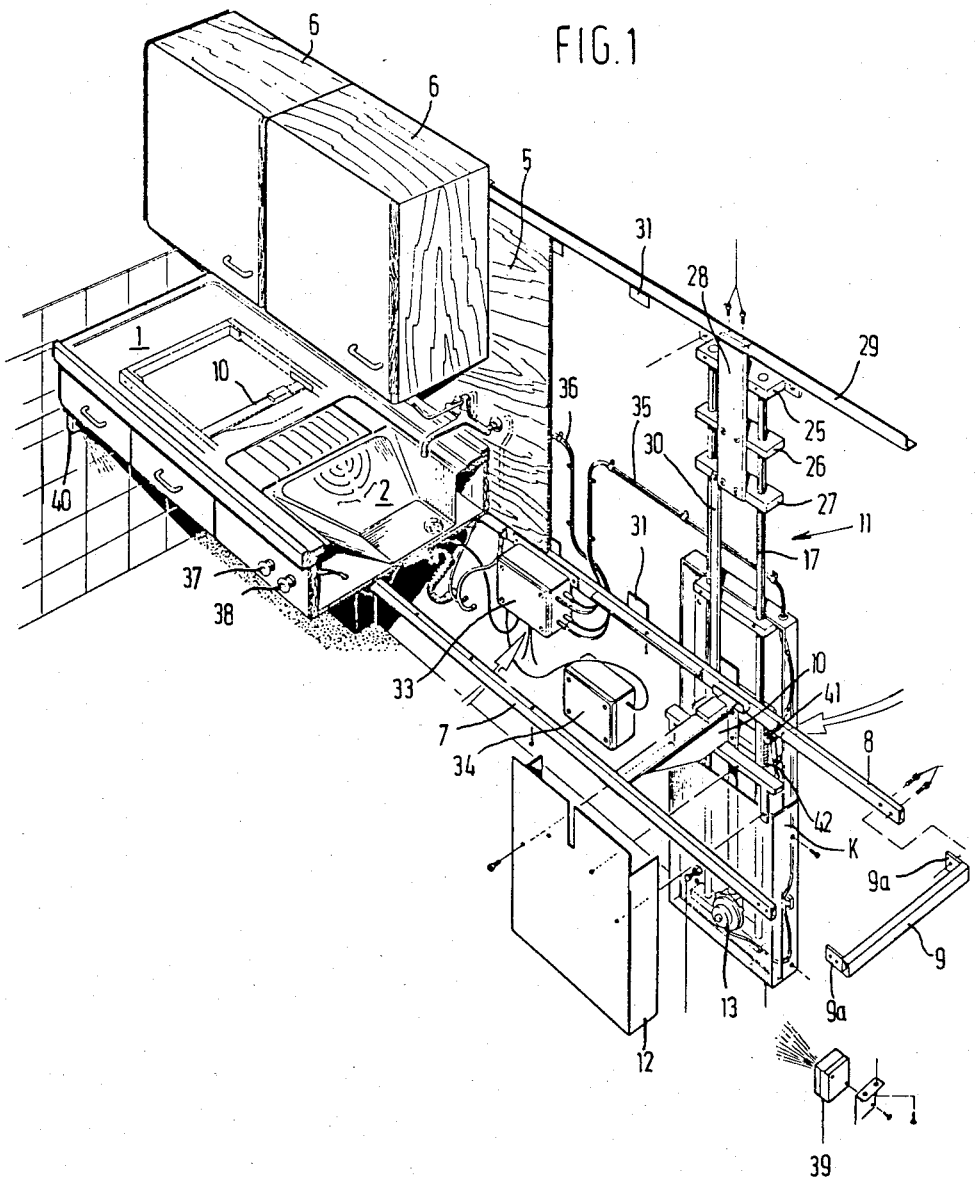

FIG. 1 diagramatically shows an embodiment of a vertically adjustable work top according to the invention, used in a kitchen. For the sake of clarity, the work top 1 is shown in part only, and is provided with a sink 2 having a flexible discharge hose 3. Above the sink there is mounted a tap 4 on a rear wall 5 which further carries overhead cupboards 6.

As will be further described hereinafter, in the embodiment shown the rear wall with the overhead cupboards and the tap is vertically adjustable together with the work top. The tap 4 is therefore provided in a known manner with at least partly flexible supply pipes for hot and cold water.

The work top 1 rests on an elongated frame comprising two longitudinal girders 7,8 interconnected by two or more cross girders, one of which, indicated at 9, is visible.

The longitudinal girders are preferably made of standard metal section stock, in this embodiment a box section, and the cross girders, which may be made of the same stock, are provided with flanges **9*a***, which can be attached to the longitudinal girders by means of bolts. In this manner, the frame can be made of any desired length in a simple manner, without it being necessary to keep many different parts in stock.

Figure 2:
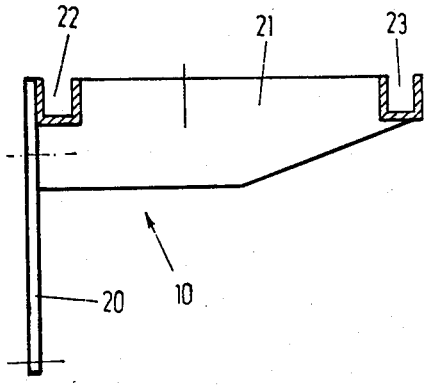
FIGS. 2 and 3 show a detail of FIG. 1.

The frame rests on a plurality of spaced apart carrier arms 1O, e.g. two. An example of such a carrier arm is shown in FIG. 2. The carrier arm 10 comprises a portion 20, vertical in mounted condition, which can be attached to a lifting device to be described hereinafter, and a horizontal portion 21, comprising two recesses 22,23 receiving the longitudinal girders 7,8 of the frame.

FIG. 1 shows furthermore a lifting device 11. In most practical cases, two lifting devices are used. However, FIG. 1 shows only one lifting device.

The lifting device 11 is attached to a stationary wall and, insofar as the lifting device is disposed underneath the work top, is covered by a cover plate 12.

Figure 3:
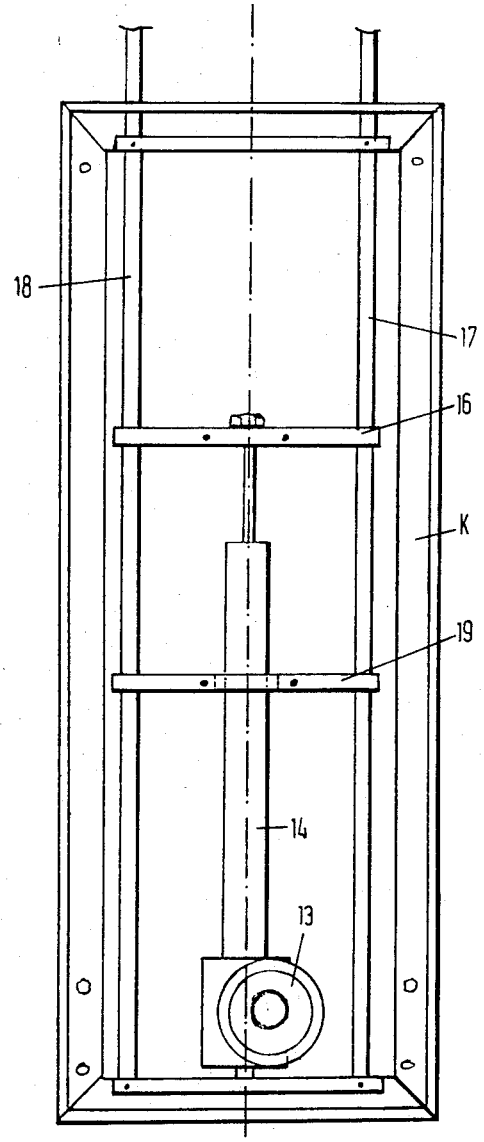

The lifting device 11 comprises an electric motor 13 (see also FIG. 3). The electric motor 13 is coupled in a known manner to a telescopically extensible, vertically extending assembly comprising a member such as a tube 14 wherein another member such as a tube or rod 15 can slide in vertical direction. Such an assembly of an electric motor and a telescopic rod system is commercially available in various embodiments under the name of linear actuator.

The tube 14 is fixedly mounted and the top end of the tube or rod 15 is connected to a horizontally extending yoke 16. On either side of the telescopically extensible system, there are provided vertical tubes or rods 17,18 extending through corresponding openings in the yoke 16 in such a manner that the yoke can slide along the tubes or rods 17,18.

The vertical portion 20 of the carrier arm 1O is attached to the yoke 16 and also to a second, lower yoke 19, provided with bores through which extend the tube 14 and the tubes or rods 17,18. The yoke 14, like the yoke 16, is arranged to slide over the tubes or rods 17,18 and also over the tube 14.

The motor, the telescopic system and the rods or tubes are accommodated in a flat cupboard K attachable to a rear wall.

In case besides the work top itself, any overhead cupboards are to be vertically adjustable, the rods or tubes 17,18 extend to above the work top, as shown in FIG. 1. The top ends of the tubes or rods 17, 18 are then mounted in a wall support 25 attachable to a wall. Between the top of the work top and the wall support, there are disposed two further yokes 26,27, which are adapted to slide along the rods or tubes 17,18 and which are interconnected by a vertical plate 28 extending to above the wall support 25 and carrying at that location a horizontal upper girder 29.

The lower yoke 27 is connected to the girder 8 or to the yoke 16 by means of a vertical strip 30 so that, when the yoke 16 is moved upwardly or downwardly by the rod or tube 15, the yokes 26,27, the plate 28 and the horizontal upper girder 29 move along with it. Mounted between the frame girder 8 and the upper girder 29, is the rear wall plate 5, which carries the wall cupboards 6 and which may be finished in a conventional manner. The wall plate 5 may be covered e.g. with tiles.

For the purpose of the attachment of the wall plate, the frame girder 8 and the upper girder 29 are provided with a plurality of lips 31.

Between the rear wall plate 5 and the wall on which the lifting device is mounted, there is provided an interspace wherein the required pipes can be accommodated. The rear wall plate 5 also covers the upper portion of the lifting device.

Underneath the work top, there is further mounted an electric control device for the lifting device(s) in one or more boxes 33,34.

In the embodiment shown, the box 33 is connected, by means of electric leads 35,36, to the motor 13 of the lifting device shown in FIG. 1 and to the motor of a second lifting device, not shown in FIG. 1.

Furthermore, adjacent the front of the work top, there are disposed control buttons 37,38, which are connected to the electric control device by means of electric leads, and which serve for energizing the lifting device(s) in the desired direction of movement.

Underneath the work top there is mounted at one end a light source or infrared source 39 and at the other end a photosensitive or infrared-sensitive cell 40, which in case of interruption of the light beam, cause the motors 13 to be switched off at least during a downward movement of the work top. This arrangement ensures protection of a person sitting with his legs underneath the work top.

Besides, a potentiometer 41 fitted with a gear wheel is mounted on the frame girder 8 adjacent each lifting device, which meter is coupled to the control device and serves for detecting the position of the work top. The gear wheel of the potentiometer coacts to this end with a stationary toothed rack 42, which may be mounted e.g. on the sidewall of the cupboard K or on one of the rods or tubes 17,18.

Figure 4:
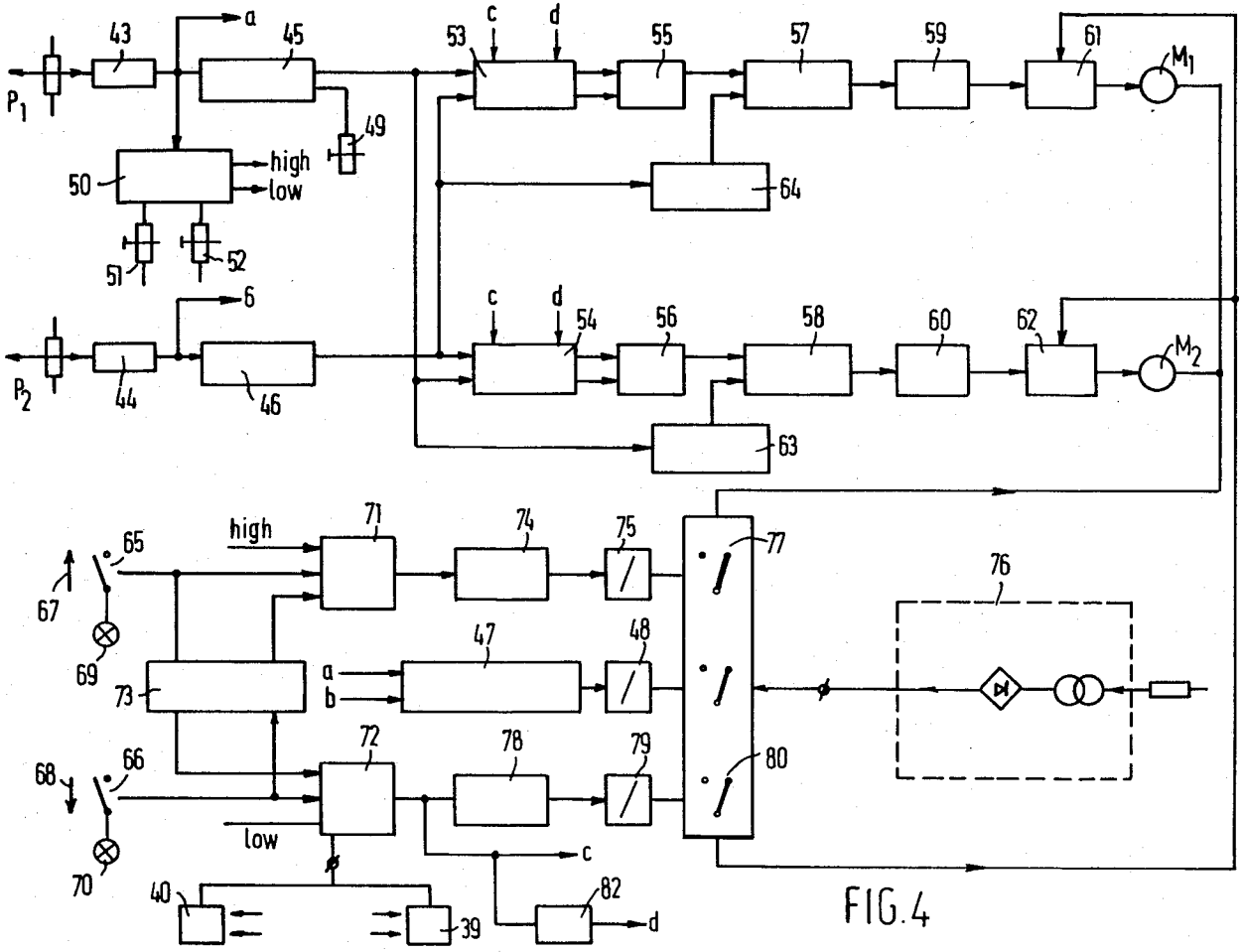
FIG. 4 shows an electric block diagram of a control device for the kitchen shown in FIG. 1.

FIG. 4 shows an electric block diagram of the control device for an adjustable work top fitted with two lifting devices, as shown in FIG. 1.

FIG. 4 shows the potentiometers, indicated at P1 and P2 in FIG. 4, associated with each of the two lifting devices. Each potentiometer is connected to a follower circuit 43,44, the output signals of which are supplied to a buffer circuit 45,46 and to a comparator circuit 47 by means of terminals a,b. The comparator circuit 47 compares the output signals of the follower circuits and disconnects, through a relay 48, the supply of the two motors M1, M2 if there is a predetermined difference, e.g. one corresponding with a difference in height of 1.5 cm, between the output signals of the follower circuit.

To this effect, one of the buffer circuits, in this embodiment the buffer circuit 45, is connected to a potentiometer 49 by means of which the horizontal position of the work top can be initially adjusted.

Moreover, the output of one of the follower circuits, in this embodiment the follower circuit 43, is connected to a high-low setting circuit 50, comprising a setting potentiometer 51 for the highest position, a setting potentiometer 52 for the lowest position, and which transmits "high" and "low" blocking signals, respectively, when the highest, and the lowest position, respectively, is reached, each of said signals being supplied to gating circuitsto be described hereinafter.

Associated with each lifting device is an analog double switch 53,54, whose position is determined by signals c and d. The signal originating from the buffer circuitry 45 and also from the buffer circuitry 46 is supplied to the switch 53. This also applies to the switch 54. Both analog switches have two outputs which are supplied to the positive and the negative input of an associated amplifier 55,56. Depending on the state of the signals c and d, the input signals of the switches 53,54 are transmitted to the amplifiers 55,56 directly or crosswise.

The amplifiers 55,56 in the embodiment shown amplify 18 times and the output signal of each amplifier is supplied to an associated comparator circuit 57,58, which transmits pulse-shaped motor control signals to a triac 61,62 by means of an opto-coupler 59,60. The triacs control the motors M1 and M2 of both lifting devices.

The output signal of the buffer circuit 45 is moreover supplied to a proportional control circuit 63, which forms from this signal a sawtooth signal that is supplied to the comparator 58. Likewise, the output signal of the buffer circuitry 46 is supplied to a similar proportional control circuit 64 whose sawtooth output signal is supplied to the comparator 57.

If the output signals of the potentiometers P1 and P2, and hence the output signals of the associated buffer circuits 45,46 differ in such a degree that this difference corresponds with a predetermined difference in height of e.g. 1 cm between the two lifting devices, this is detected by the comparator 57 or the comparator 58, and the output signal of either comparator is readjusted in such a way that the associated motor is slowed down. It is thus effected that the work top remains at all times levelled up as best as possible.

Two operating switches 65 and 66 are provided for operating the electric control device. The switch 65, as indicated by an arrow 67, serves for lifting the work top, while the switch 66 serves for lowering the work top, as indicated by an arrow 68. The switches 65 and 66 are preferably each provided with an indicator lamp or a LED 69,70.

The operating switch 65 is connected to the input of an AND-gating circuit 71, likewise comprising a blocking input to which the "high" signal from the high-low setting circuit is supplied so as to block the gating circuit when the highest position is reached.

Further, the gating circuit 71 has a locking inpunt connected to the other operating switch 66, so that the gating circuit 71 can only transmit an output signal if exclusively the operating switch 65 is operated. Likewise, a gating circuit 72 associated with the other operating switch has a locking input connected to the operating switch 66. In the connection leads between the operating switch associated with a gating circuit and the gating circuit associated with the other operating switch, there is provided a delay device diagrammatically indicated at 73, which, when an operating switch is nog longer operated, effects that the other gating circuitry is not released until after a predetermined delay time of e.g. 1 sec., thus preventing unstable states of the control device.

The gating circuit 71, after energization by means of the operating button and in the absence of the "high" blocking signal and the locking signal, provides an output signal that energizes a relay 75 by means of a buffer circuit 74. The relay 75 has a switching contact 77 connected to a supply circuit 76, which contact, upon energization of the relay, energizes the motors M1,M2 and the triacs 61,62 in such a manner that the motors start running in the desired direction to lift the work top.

Similarly, the output signal of the gating circuit 72 can energize a relay 79 through a buffer circuit 78 so that the motors M1,M2 are energized in the other direction by means of an associated relay contact 80.

The gating circuit 72, besides the "low" blocking input, the input connected to the operating switch 66, and the locking input, has another additional blocking input 81, which is connected to the light or infrared barrier disposed underneath the work top, and which stops the downward movement when the light or infrared beam is interrupted.

Furthermore, derived from the output of gating circuit are, directly, the signal c and, through an inverter 82, signal d, which signals define the position of the switches 53,54.

The supply 76, starting from the mains voltage, provides a fullwave rectified voltage of e.g. 24 V for the energization of the motors.

It is observed that various modifications will readily occur to one skilled in the art after the foregoing. For instance, a single lifting device will be sufficient for a small work top. In that case, the electric control device can be simplified accordingly, in that only a single potentiometer P1 or P2 with the associated control circuit is necessary for a single motor. The comparator 47 may then be dispensed with, too. Such modifications are deemed to fall within the scope of the invention.

I claim:

1. An adjustable work top attachable to a wall, in particular suitable for a kitchen, including means for attaching said work top to said wall and means for vertically adjusting said work top; characterized in that said means for vertically adjusting said work top include at least one electric motor-driven lifting device attachable vertically to said wall, which lifting device is provided with a horizontally extending carrier arm for carrying said work top and attachment members for mounting said carrier arm in cantilever fashion, which lifting device further includes a vertically mounted, telescoping assembly adjustable by means of the electric motor, said assembly having a member which is extensible and retractable relative to a stationary guide tube, said member comprising at least one substanitally horizontally extending yoke to which said carrier arm for said work top can be attached, said adjustable work top further including an electric control device for controlling said electric motor.

2. An adjustable work top according to claim 1, characterized in that, at the two ends away from the extensible and retractable member, said yoke is provided with bores through which extend corresponding vertical guides along which the yoke can slide up and down.

3. An adjustable work top according to claim 2, characterized in that the vertical guides extend to beyond the uppermost position of the work top and that adjacent the upper ends of the vertical guides, at least a second yoke is coupled for up and down sliding movement to the vertical guides, which second yoke is fixedly connected to the first yoke by means of a connecting member and is further connected to attachment members for a wall plate.

4. An adjustable work top according to claim 3, characterized in that one or more cupboards are attached to the wall plate at some interspace above the work top.

5. An adjustable work top according to claim 3, characterized in that the attachment members for the wall plate comprise a substantially horizontally extending girder adapted to cover the upper edge of the wall plate.

6. An adjustable work top according to claim 5, characterized in that the girder is provided with a plurality of downwardly extending lips and that the work top is provided at the side facing the wall with a plurality of upright lips serving for attachment of the wall plate.

7. An adjustable work top according to claim 1, characterized in that the work top is provided with a frame consisting of a pair of longitudinal girders and a pair of end connecting pieces.

8. An adjustable work top according to claim 7, characterized in that the carrier arm has recesses receiving the longitudinal girders of the frame.

9. An adjustable work top attachable to a wall, in particular suitable for a kitchen, including means for attaching said work top to said wall and means for vertically adjusting said work top; characterized in that said means for vertically adjusting said work top include at least one electric motor-driven lifting device attachable vertically to said wall and an electric control device for controlling said electric motor, which lifting device is provided with a horizontally extending carrier arm for carrying said work top and attachment members for mounting said carrier arm in cantilever fashion, each said lifting device is fitted with a fixedly mounted vertical toothed rack coacting with a gear mounted on the shaft of a potentiometer which is fixedly coupled to said work top and electrically connected to the electric control device for detecting the position of the associated potentiometer.

10. An adjustable work top according to claim 9, and provided with two lifting devices, characterized in that the electric control circuit comprises a first follower circuit connected to the potentiometer P1 associated with the first lifting device and a second follower circuit connected to the potentiometer P2 associated with the second lifting device, and that the output signals of the follower circuits are supplied to a comparator which, when a predetermined difference between these output signals is exceeded, transmits a signal that effects that the energization of the electric motors is disconnected.

11. An adjustable work top according to claim 10, characterized in the control signals are formed from the output signals of follower circuits for the electric motor associated with each lifting device, said control signals for each electric motor being compared in a comparator with an output signal originating from a proportional control circuit receiving an input signal originating from the follower circuit associated with the other lifting device, while when a predetermined difference between the input signals of a comparator is exceeded, the control signal for one of the electric motors is influenced in such a manner that this electric motor is slowed down.

12. An adjustable work top attachable to a wall, in particular suitable for a kitchen, including means for attaching said work top to said wall and means for vertically adjusting said work top; characterized in that said means for vertically adjusting said work top include at least one electric motor-driven lifting device attachable vertically to said wall and an electric control device for controlling said electric motor, which lifting device is provided with a horizontally extending carrier arm for carrying said work top and attachment members for mounting said carrier arm in cantilever fashion, a source of radiation mounted underneath said work top adjacent one end thereof and a radiation-sensitive cell mounted underneath said work top adjacent the other end, which cell is electrically connected to said electric control device and which, in case of interruption of the thus formed radiation barrier during a downward movement of said work top, disconnects the supply of the electric motor of each lifting device.

13. An adjustable work top attachable to a wall, in particular suitable for a kitchen, including means for attaching said work top to said wall and means for vertically adjusting said work top; characterized in that said means for vertically adjusting said work top include at least one electric motor-driven lifting device attachable vertically to said wall and an electric control device for controlling said electric motor, which lifting device is provided with a horizontally extending carrier arm for carrying said work top and attachment members for mounting said carrier arm in cantilever fashion, said electric control device including an operating switch for the upward movement of said work top and an operating switch for the downward movement of said work top, while the control signal generated by the operation of each said operating switch energizes an associated relay by means of an associated AND-gating circuit, said relay having a switching contact in the supply circuit of the electric motor of each said lifting device and which effects that power is supplied to the electric motor in such a manner that this is energized to run in the direction of movement of the work top corresponding with said operating switch operated.

14. An adjustable work top according to claim 13, characterized in that the control signal supplied by an operating switch, after its operation, to the input of the associated AND-gating circuit is also supplied as blocking signal to the input of the AND-gating circuit associated with the other operating switch.

15. An adjustable work top according to claim 13, characterized in that each lifting device is fitted with a fixedly mounted vertical toothed rack coacting with a gear mounted on the shaft of a potentiometer which is fixedly coupled to the work top and electrically connected to the electric control device for detecting the position of the associated potetiometer and that the output of one of the potentiometers is connected to high-low setting circuit for setting the maximum and minimum height of the work top, which high-low setting circuit, when the maximum or minimum height of the work top is reached, transmits an output signal that is supplied as blocking signal to one of the inputs of the AND-gating circuit associated with the operating switch for the upward and downward movement of the work top.

* * * * *